United States Patent [19]

Latham

[11] Patent Number: 5,052,757

[45] Date of Patent: Oct. 1, 1991

[54] FLIGHTING SECTION AND TOOTH HOLDER

[75] Inventor: Winchester E. Latham, Indianapolis, Ind.

[73] Assignee: Keystone Engineering & Manufacturing Corporation, Indianapolis, Ind.

[21] Appl. No.: 535,657

[22] Filed: Jun. 11, 1990

[51] Int. Cl.[5] ..... E21C 35/18

[52] U.S. Cl. ..... 299/87; 299/39

[58] Field of Search ..... 299/39, 86, 87, 88, 299/89, 91, 79; 175/394, 377

[56] References Cited

U.S. PATENT DOCUMENTS 2,197,549 4/1940 Hargrave et al. ..... 299/25
3,847,439 11/1974 Allen ..... 299/87 X
4,268,089 5/1981 Spence et al. ..... 299/87
4,480,873 11/1984 Latham ..... 299/87

FOREIGN PATENT DOCUMENTS 638718 12/1978 U.S.S.R. ..... 299/87

*Primary Examiner*—David J. Bagnell
*Attorney, Agent, or Firm*—Locke Reynolds Boyd & Weisell

[57] ABSTRACT

A rotary drive cutter for use on the rodway surface reclaiming machines is disclosed which includes spiral flighting fixed to an axially rotatable drum, the flighting includes a plurality of regularly spaced recesses for receiving tool holders each being removably mounted within the flighting recess such that an edge of the tool holder projects laterally outward beyond the side of the flighting a distance sufficient to protect the flighting section from abrasion and thereby extend the life thereof.

11 Claims, 2 Drawing Sheets

FLIGHTING SECTION AND TOOTH HOLDER

The present invention is directed generally to rotary driven cylindrical cutters and scarifiers for use in earth-working, mining, or other in situ disintegration of hard materials. The invention is particularly directed to such rotary driven cylindrical cutters and scarifiers as incorporate means for feeding or excavating the material cut or mined away from its initial location generally to a second material-carrying means.

The inventions has particular utility in connection with roadway resurfacing machines which include rotary driven cylincrical cutters and appropriate conveying apparatus entirely supported on a mobile ground engaging vehicular platform. Examples of the prior art are to be found in Hargrave U.S. Pat. No. 2,197,549; Jakob et al U.S. Pat. No. 4,139,318; Ratcliff, Jr. U.S. Pat. No. 4,311,284; Swisher, Jr., et al U.S. Pat. No. 4,325,580; and Latham U.S. Pat. No. 4,480,873.

In general, the roadway mining or planing equipment disclosed in the prior art includes a rotary driven cylindrical comminuting drum which acts to scarify and to mine the top portion of the asphaltic road surface in situ. The rotary driven drum includes flighting on the drum which acts to collect the mined material toward the center of the drum where it can be removed. Often the mined material is then remixed with additional bituminous material and thereafter redeposited as a newly formed smooth asphaltic surface.

In some prior art devices of this type, the flighting is itself formed from a plurality of cutting bit support members which are connected to the curved surface of the cutting drum by bolts which pass from the upper surface of the flighting downward into the drum to engage threaded openings in the drum. Alternatively, the bolts may pass through the surface of the drum to engage lock washers and threaded nuts on the interior of the drum. A plurality of the cutting bit supporting members are arranged end-to-end so as to form a substantially continuous helical flighting. The top surface of the helical flighting is elevated above the curved surface of the drum. The top surface includes angled openings into which conventional cutting bits are received.

In use, the abrasive forces, which often include rather high value sudden shocks, are transmitted from the cutting bits into the supporting members and the bolts securing the supporting members to the smooth drum surface. The forces occasionally become large enough to shear the securing bolts, causing the machine to be stopped often for considerable lengths of time. The repair and replacement of the cutting bit supporting member damaged in this manner typically necessitates the use of an easy-out or similar removing tool in the field to remove the portions of the sheared bolts remaining in the drum. This is a time-consuming repair job which results in considerable expense to the road-mining machine operator.

In an attempt to avoid the problems presented by the bolt-secured supporting members, other roadway planing devices include a continuous flighting welded in place in helical fashion on the surface of the drum. A plurality of individual cutting bit support blocks are welded to the upper edge of the flighting. The support block includes a recess for receivng a cutting bit of a chisel cutter preferably having a tungsten carbide tip or the like.

In use, the cutting bits vibrate and otherwise move within the support block recess. Particularly in the presence of abrasive dust from the roadway mining operation, the vibration and movement of the cutting bits act to enlarge the recesses to such an extent that the cutting bit is no longer retained. It then becomes necessary to remove the old support block, usually with the aid of a cutting torch, and to weld a new support block in its place. Again, this repair job is difficult to do in the field and still achieve accurate alignment of the support block on the flighting section. Misalignment of the support block results in undersirable lateral forces on a new cutting bit which in turn results in very fast wear and ultimate failure of the replaced parts. The present invention is intended to avoid many of the difficulties of the prior art by constructing the drum-mounted flighting and tool holders to have particularly advantageous features. The flighting consists of a plurality of helical flighting sections, typically 90° archs, which are fixed by welding them to the cutting drum. Each flighting section includes a plurality of recesses in one side of the flighting. Each flighting section includes a plurality of backup blocks on the wear side of the recess. The backup block is drilled and tapped to accept a threaded fastener. The fastener passes through the backup block and rests against the back of the tool holders. The opposing lower edge of the flighting recess and the tool block are threaded to accept threaded fastener means. A plurality of tool holders are removably mounted within the flighting section recesses. Each tool holder includes a bore which typically receives a tungsten carbide-tipped cutting bit.

Each helical flighting section has a first wall which contains the recesses for receiving the tool holders and a second opposing wall which does not have the recesses. Both walls are generally perpendicular to the cutting drum so as to define the intended flighting for feeding the excavated material from its initially mined location to a central point where it can be removed by appropriate conveying apparatus. Each of the tool holders generally projects outward beyond the surface of the first wall containing the recesses, and in this manner presents wear points or wear surfaces to be acted upon by the abrasive mine asphaltic road material. Thus, the sideways projecting portions of the tool holders act to protect the flighting sections itself so as to extend the life thereof.

In use, the cutting bits will vibrate or otherwise move with respect to the tool holders, just as in the prior art, which will ultimately result in loss of retention of the cutting bit and necessitate replacement of the tool holder. This replacement is easily achieved by the removal of the threaded fasteners holding the tool holder in the recess in the flighting.

The replacement of the worn cutting tool holder is simplified in that a recess is provided directly in the flighting to accept a cutting tool holder, thereby assuring its proper positioning and alignment. This also acts to increase the usable life of the cutting bits themselves since proper alignment between the cutting bit and drum is assured.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
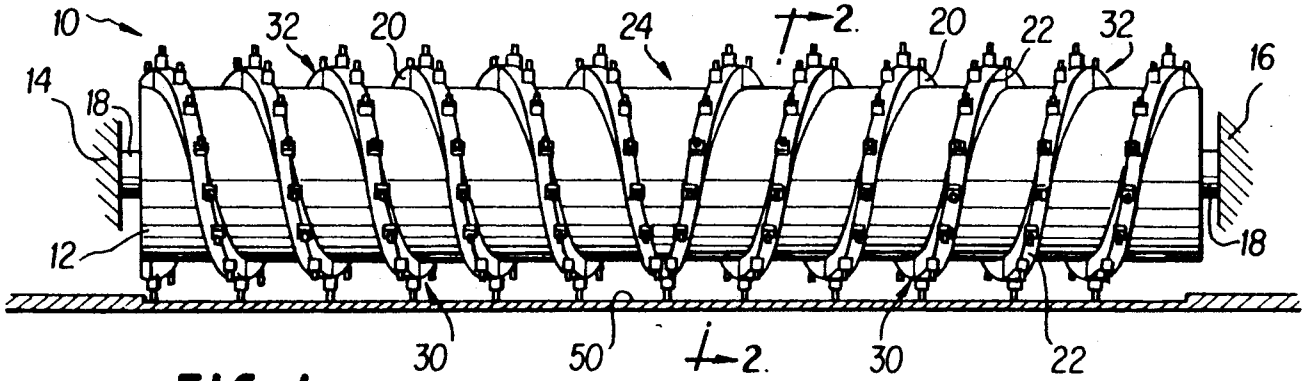
FIG. 1 shows a front plan view of a rotary driven cylindrical cutter according to the present invention.
Figure 3:
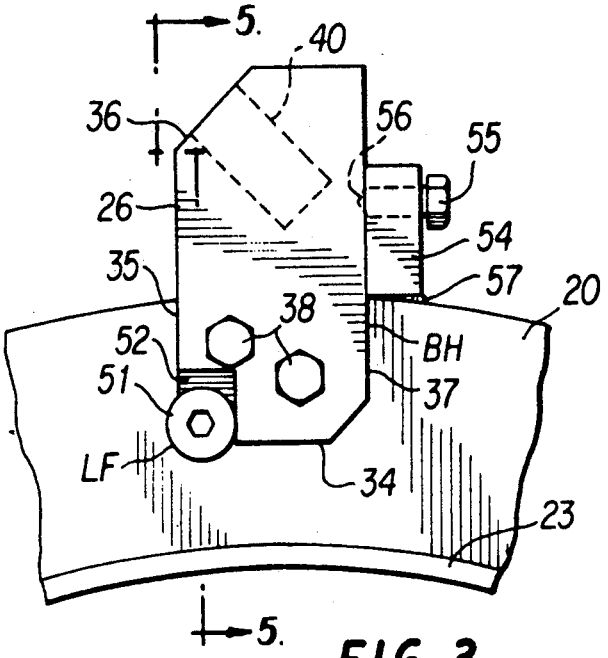
FIG. 3 is a side view of a typical flighting section containing the tooth holder.
Figure 5:
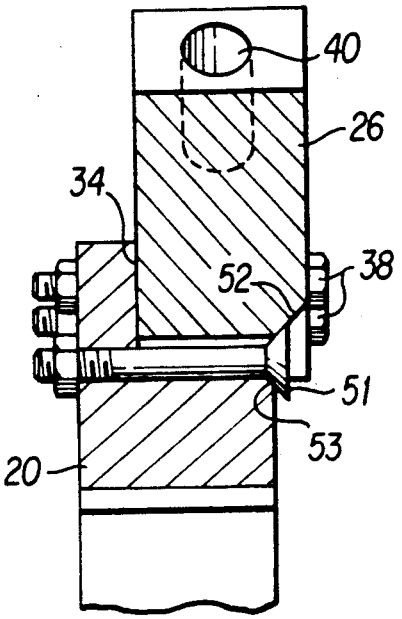
FIG. 5 is a sectional view of the flighting and tooth holder taken along line 4—4.
Figure 4:
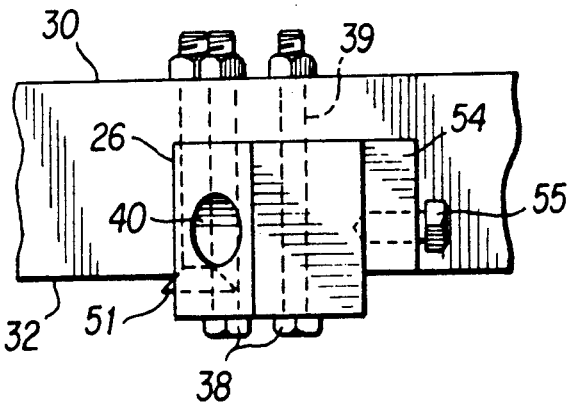
FIG. 4 is a top view of FIG. 3.
Figure 6:
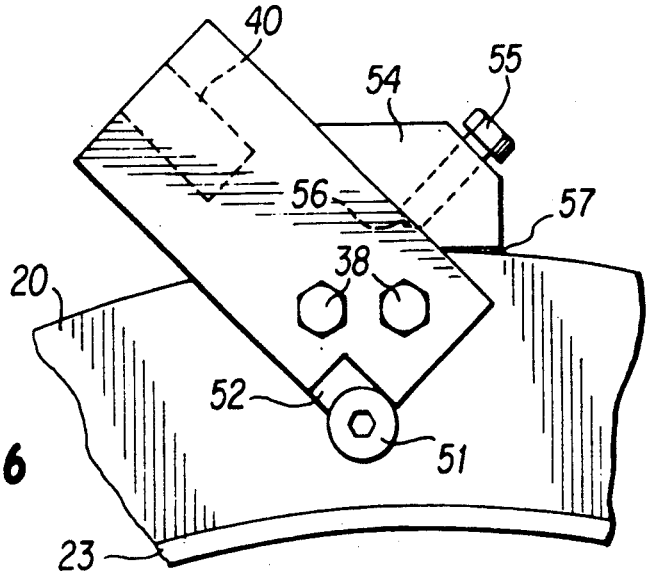

FIG. 6 is an alternative design option for the flighting containing the tooth holder shown in FIG. 3-5. The tooth holder is placed along the tooth attack angle instead of perpendicular to the cutting drum A rotary driven cylindrical cutter 10 in accordance with the present invention includes a cylinder 12 supported generally at both ends by an appropriate support means 14 and 16 and driven for rotation by a motor not shown through stub shafts 18. Flighting 20, which generally comprises arcuate flighting portions 22, are welded by welds to 23 to the outer surface 13 of drum 12 for continuous movement therewith. The rotation of the drum 12 is such that, as shown in FIG. 1, the lower portion of the drum moves out of the plane of the paper and upward toward the top of the drum. It will be seen that with this motion taking place, the flighting 20 acts to drive material contracted by the flighting toward the lateral center 24 of the drum.

Figure 2:
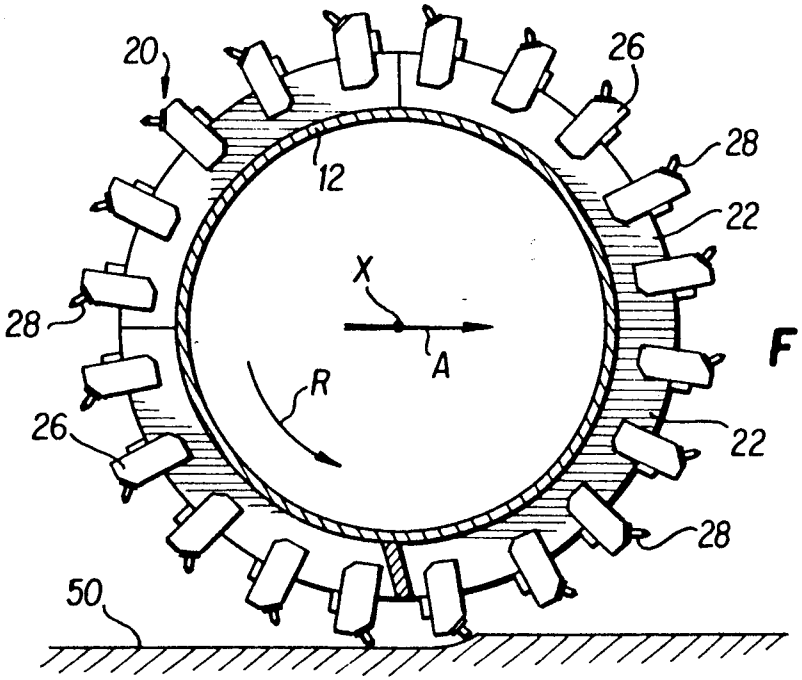
FIG. 2 is a sectional view of the cutter shown in FIG. 1, taken along line 2—2.

The rotation of the drum 12 is seen in FIG. 2 to be in the clockwise direction R about axis X while the overall apparatus proceeds in the direction given by arrow A. A plurality of tool holders 26 are removably mounted to the flighting sections 22, and each tool holder includes at its radial outward extremity a cutting tool 28, typically carbide-tipped, which is directed forward in the direction of rotation of the drum. The cutting tools 28 are caused to contact the road surface 30 and, in a known manner, mine a controlled portion of the road surface and thereby leave the surface substantially planar but with a slightly roughened surface texture so as to ensure superior bonding to any subsequently applied new surfacing materials.

The flighting 20 has two surfaces 30 and 32 generally perpendicular to the surface 13 of drum 12. The first perpendicular surface 30 is seen to face generally toward the lateral center 24 of drum 12, while surface 32 is seen to face toward end shaft 18 of drum 12. A plurality of recesses 34 are provided on the inside surface 30. Each recess 34 is defined by a forward wall 35 and rearward wall 37, both of which are preferably arranged parallel to the axis of rotation of drum 12. A tool holder 26 is received snugly within recess 34 such that an edge 36 of the tool holder 26 projects beyond the plane of inside surface 30. The tool holder 26 is secured in position by means of screw-threaded fasteners 38 passing through the flighting section 22 from the outside surface 32 to engage threads 39 within the tool holder 26. The tool holder itself includes inclined recess 40 for receiving the butt end of replaceable cutting tool 28 in the conventional manner. The cutting tool 28 is aligned by the recess to the tool holder 26 so as to be forwardly directed on the bottom portion of drum 12 as shown in FIG. 2.

The action of the rotary driven cutter against the roadway surface 50 produces stress which causes great wear at two pressure points known as back high (BH) and low forward (LF). To compensate for the low forward stress fastening means in the form of, a wedge or a tapered bolt 51 is added to point LF. The corners of the tool holder 52 and the corners of the flighting 53 are machined in order to contain the tapered head of the bolt 51. To compensate for the back high stress, a back up seat 54 is bolted or welded 57 behind the tool holder 26 and on top of flighting 20. Dial bolt 55 tightens tool holder 26 to back up seat 54. The dial bolt 55 tightens into a machined notch 56; this allows for the varying of pressure at point BH.

FIG. 6 displays an alternative directional design for tool holders 26 placed into flighting 20. This time the tool holder is oriented in the direction of the attack angle of the cutting tool 28.

With both designs, the tool holder 26 is mounted in such a way to control stress on the tool holder and flightings 20, and in such a way as to achieve maximum efficiency in applying force to the roadway surface and in brushing a side the waste product produced.

Although the invention has been described in detail with reference to preferred embodiments, variations and modifications exist within the scope and spirit of the invention as described and as claimed in the following claims.

What is claimed is:

1. Apparatus secured to a cutting drum of a scarifying milling machine for holding a cutting bit comprising:

a plurality of flighting sections fixed to said cutting drum, each flighting section including a first wall containing a plurality of recesses for receiving tool holders, a second wall generally parallel to the first wall, both the first and second walls being generally perpendicular to the cutting drum, and a top wall defining the outer periphery of the flighting section and joining the first and second walls, a plurality of tool holders, each tool holder being removably mounted within one of the flighting section recesses of the first wall so as to project outward from the first wall a distance sufficient to protect at least a part of the flighting section from abrasion so as to extend the life of the flighting section, each tool holder including a tapered surface on a lower forward edge facing outward from the first wall and radially downward toward the cutting drum, and fastening means for fastening each tool holder to the flighting section including a fastener having a tapered head portion contacting said tool holder tapered surface to wedge the tool holder into intimate contact with the flighting section recess.

2. The apparatus of claim 1 wherein each tool holder includes a channel extending across the lower forward edge, said fastener being received in said channel.

3. The apparatus of claim 1 further comprising a back up seat fixed to said flighting section top wall adjacent to each tool holder, and adjusting means adjustable with respect to each back up seat and contacting a rearward surface of each tool holder for adjusting the forward pressure on the tool holder.

4. The apparatus of claim 3 wherein each tool holder includes a recess in the rearward surface thereof for receiving said adjusting means.

5. Apparatus secured to a rotatable cutting drum of a scarifying milling machine for holding a cutting bit comprising:

a plurality of flighting sections fixed to said cutting drum, each flighting section including a first wall generally facing the lateral center of the drum, a second wall generally parallel to the first wall and facing a lateral edge of the drum, both the first and second walls being generally perpendicular to a cylindrical surface of the drum, a top wall defining the outer periphery of the flighting section and joining the first and second walls, and at least one region for receiving a tool holder, a plurality of tool holders, each tool holder including a recess for receiving a butt end of a replacable cutting tool, each tool holder being removably mounted in one of the tool holder receiving regions of one of the flighting sections such that the cutting tool receiving recess projects in a generally outward and rotationally forward direction with respect to the drum, each tool holder including a tapered surface on a lower forward edge facing outward from the first wall and radially downward toward the cutting drum, and fastening means for fastening each tool holder to the flighting section including a back up seat fixed to said flighting section top wall adjacent to each tool holder, and adjusting means adjustable with respect to each back up seat and contacting a rearward surface of each tool holder for adjusting the forward pressure on the tool holder.

6. The apparatus of claim 5 wherein each tool holder includes a recess in the rearward surface thereof for receiving said adjusting means.

7. The apparatus of claim 5 wherein the fastening means further comprises a fastener having a tapered head portion contacting said tool holder tapered surface to wedge the tool holder into intimate contact with the tool holder receiving region.

8. The apparatus of claim 7 wherein each tool holder includes a channel extending across the lower forward edge, said fastener being received in said channel.

9. Apparatus secured to a rotatable cutting drum of a scarifying milling machine for holding a cutting bit comprising:

a plurality of flighting sections fixed to said cutting drum, each flighting section including a first wall generally facing the lateral center of the drum, a second wall generally parallel to the first wall and facing a lateral edge of the drum, both the first and second walls being generally perpendicular to a cylindrical surface of the drum, a top wall defining the outer periphery of the flighting section and joining the first and second walls, and at least one region for receiving a tool holder, a plurality of tool holders, each tool holder including a recess for receiving a butt end of a replacable cutting tool, each tool holder being removably mounted in one of the tool holder receiving regions of one of the flighting sections such that the cutting tool receiving recess projects in a generally outward and rotationally forward direction with respect to the drum, each tool holder including a channel extending across a lower forward edge and a tapered surface on a lower forward edge facing outward from the first wall and radially downward toward the cutting drum, fastening means for fastening each tool holder to the flighting section including a fastener received in said channel having a tapered head portion contacting said tool holder tapered surface to wedge the tool holder into intimate contact with the tool holder receiving region, and a back up seat fixed to said flighting section top wall adjacent to each tool holder, and adjusting means adjustable with respect to each back up seat and contacting a rearward surface of each tool holder for adjusting the forward pressure on the tool holder, each tool holder includings a recess in the rearward surface thereof for receiving said adjusting means.

10. The apparatus of claim 9 wherein said tool holder projects radially with respect to said drum and said cutting tool receiving recess is inclined with respect to said tool holder.

11. The apparatus of claim 9 wherein said tool holder projects in a generally outward and rotationally forward direction with respect to the drum and said cutting tool receiving recess is aligned with respect to said tool holder.

* * * * *